US009291971B2

(12) United States Patent
Tashiro

(10) Patent No.: US 9,291,971 B2
(45) Date of Patent: Mar. 22, 2016

(54) IMAGE FORMING APPARATUS

(71) Applicant: KYOCERA Document Solutions Inc., Osaka-shi, Osaka (JP)

(72) Inventor: Masaya Tashiro, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/137,738

(22) Filed: Dec. 20, 2013

(65) Prior Publication Data

US 2014/0186060 A1 Jul. 3, 2014

(30) Foreign Application Priority Data

Dec. 27, 2012 (JP) ..... 2012-286240

(51) Int. Cl.

*G03G 15/00* (2006.01)
*G03G 15/20* (2006.01)
*G03G 21/16* (2006.01)

(52) U.S. Cl.

CPC ..... *G03G 15/2085* (2013.01); *G03G 15/2028* (2013.01); *G03G 15/657* (2013.01); *G03G 15/70* (2013.01); *G03G 21/1638* (2013.01)

(58) Field of Classification Search

CPC ..... G03G 15/6573; G03G 21/1685; G03G 15/5012; G03G 21/1638; G03G 21/1633
See application file for complete search history.

(56) References Cited

U.S. PATENT DOCUMENTS

| | | | | |
|---|---|---|---|---|
| 2003/0021613 | A1* | 1/2003 | Koide | 399/167 |
| 2005/0135828 | A1* | 6/2005 | Joichi et al. | 399/75 |
| 2009/0026689 | A1* | 1/2009 | Noguchi et al. | 271/8.1 |
| 2011/0076046 | A1* | 3/2011 | Oh | 399/88 |
| 2011/0135326 | A1* | 6/2011 | Anno | 399/21 |
| 2013/0315610 | A1* | 11/2013 | Utagawa et al. | 399/21 |

FOREIGN PATENT DOCUMENTS

| | | | |
|---|---|---|---|
| JP | 05-127453 | | 5/1993 |
| JP | 2008183795 | A | 8/2008 |
| JP | 2011069852 | A | 4/2011 |
| JP | 2013050631 | A | 3/2013 |

* cited by examiner

*Primary Examiner* — Daniel J Colilla
*Assistant Examiner* — John M Royston
(74) *Attorney, Agent, or Firm* — Alleman Hall McCoy Russell & Tuttle LLP

(57) ABSTRACT

An image forming apparatus includes a drive roller, a rotary drive source, a rotation signal detection portion, and a removal determination portion. The drive roller is configured to rotate in contact with a printing medium. The rotary drive source is configured to supply a rotational force to the drive roller. The rotation signal detection portion is configured to detect a rotation signal indicating that the drive roller is rotated while the rotary drive source is being powered off. The removal determination portion is configured to determine whether the printing medium that has stopped in contact with the drive roller is removed, based on detection of the rotation signal by the rotation signal detection portion.

2 Claims, 4 Drawing Sheets

IMAGE FORMING APPARATUS

INCORPORATION BY REFERENCE

This application is based upon and claims the benefit of priority from the corresponding Japanese Patent Application No. 2012-286240 filed on Dec. 27, 2012, the entire contents of which are incorporated herein by reference.

BACKGROUND

The present disclosure relates to an image forming apparatus including a drive roller configured to convey a printing medium.

Conventional electrophotographic image forming apparatuses have the function of detecting any occurrence of a jam (a print sheet conveyance failure or a paper jam) in a conveyance path provided within the apparatuses, and provide a notification of the occurrence of a jam. Whether or not a jam has occurred can be determined based on a sensor signal from a sheet sensor for detecting a print sheet being conveyed along the conveyance path. Specifically, it is determined that a jam has occurred if the sheet sensor is continuously detecting a print sheet for a predetermined time or longer. If it is determined that a jam has occurred, the heating operation of a heater or the rotating operation of a heating roller of a fixing device is subjected to emergency stoppage.

In addition, a conventional image forming apparatus has a maintenance opening formed in its housing to allow easy removal of a print sheet jammed in the conveyance path, and a cover is attached to the opening. For an image forming apparatus of this type, it is hazardous if the printing operation is unintentionally performed when the operator is removing a jammed print sheet by opening the cover. Furthermore, there is the possibility that the apparatus may fail when the printing operation is performed with the cover being opened. For this reason, the conventional image forming apparatus is provided with a cover opening/closing detection sensor serving as an interlock switch for detecting opening/closing of the cover. Thereby, the heater or the heating roller of the fixing device is stopped when the cover is open even if a sheet removal operation (jam processing operation) for removing the print sheet has been completed, thus ensuring the safety of the operator and achieving a smooth jam removal operation. Note that if the sheet sensor is no more detecting a print sheet after completion of the sheet removal operation and it is determined that the cover is closed, the heater, the heating roller, and the like of the fixing device are brought into a drivable state, thus enabling the image forming operation.

Here, a jam of the print sheet does not necessarily occur at a position that can be detected by the sheet sensor. For example, the sheet sensor cannot detect such a jam in which a print sheet is wound around the heating roller of the fixing device or a conveyance roller provided on the conveyance path. In addition, a jam may occur in an area where the sheet sensor is not provided. In this case, the occurrence of a jam cannot be directly detected by the sheet sensor, and it is determined that a jam has occurred in the conveyance path if the sheet sensor does not detect a print sheet after an elapse of a predetermined time since an instruction to convey a sheet has been issued. In this case as well, the heater or the heating roller of the fixing device will be stopped for safety. However, if a jammed print sheet cannot be directly detected by the sheet sensor, the image forming apparatus estimates that the sheet removal operation has been performed and the print sheet is removed when the cover is opened and then closed again, regardless of whether the print sheet is actually removed or not. Accordingly, the image forming operation is returned to a state in which it can perform an image forming operation. In this case, performing the image forming operation by driving the heater or the heating roller of the fixing device leads to excessive heating of the jammed print sheet or application of an additional conveyance force to the jammed print sheet, resulting in a failure of the image forming apparatus.

If, on the other hand, the operator pulls out a print sheet jammed in the fixing device during the sheet removal operation in the image forming apparatus, the heating roller is rotated by the frictional force between itself and the pulled-out print sheet. It is known that the output shaft of a rotary drive source, such as a motor, that supplies a driving force to the heating roller is also rotated at this time, and a counter electromotive force is generated from the rotary drive source.

SUMMARY

An image forming apparatus according to one aspect of the present disclosure includes a drive roller, a rotary drive source, a rotation signal detection portion, and a removal determination portion. The drive roller is configured to rotate in contact with a printing medium. The rotary drive source is configured to supply a rotational force to the drive roller. The rotation signal detection portion is configured to detect a rotation signal indicating that the drive roller is rotated while the rotary drive source is being powered off. The removal determination portion is configured to determine whether the printing medium that has stopped in contact with the drive roller is removed, based on detection of the rotation signal by the rotation signal detection portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings where necessary.

Figure 1:
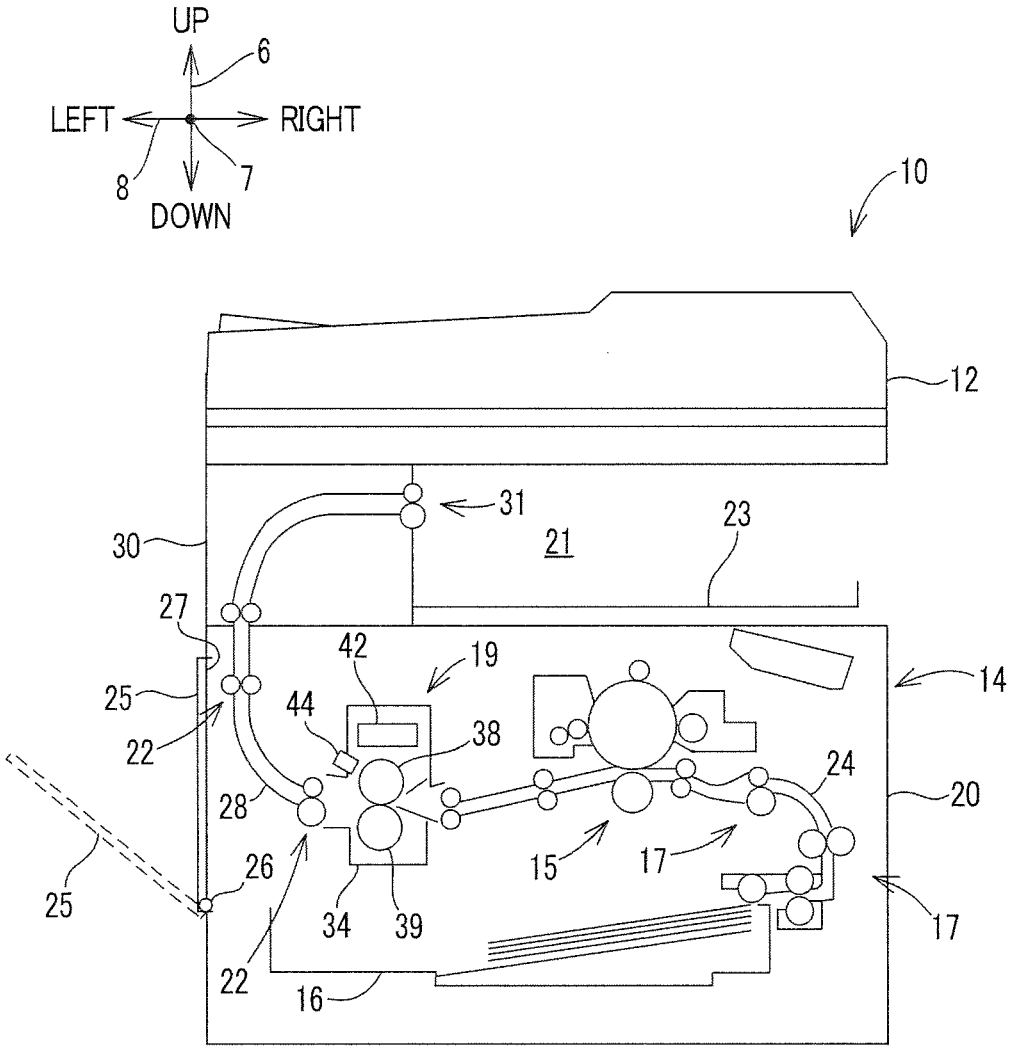
FIG. 1 is a schematic diagram showing an overall configuration of an image forming apparatus according to an embodiment of the present disclosure.

Referring first to FIG. 1, a description will be given of an overall configuration of an image forming apparatus 10 (an example of an image forming apparatus recited in the claims). In each of the drawings, in a state in which the image forming apparatus 10 is installed as shown in FIG. 1, the direction indicated by arrow 6 is defined as the up-down direction, the direction indicated by arrow 7 (the direction perpendicular to the plane of paper in FIG. 1) as the front-rear direction, and the direction indicated by arrow 8 as the left-right direction.

As shown in FIG. 1, the image forming apparatus 10 is a so-called "in-body discharge-type" multifunction peripheral having various functions such as a printer, a copier, and a facsimile. The image forming apparatus 10 prints, in color or monochrome, an input image on a print sheet (an example of a printing medium recited in the claims) by using a printing material such as toner. The image forming apparatus 10 includes, at its upper portion, a scanner 12 that reads the image of an original, and an electrophotographic image forming portion 14 at its lower portion. Also, a sheet discharge portion 30 is provided on the left side of the image forming apparatus 10 in FIG. 1. The sheet discharge portion 30 is provided so as to form a sheet discharge space 21 between the image forming portion 14 and the scanner 12, and also to couple the image forming portion 14 and the scanner 12 to each other. Note that the image forming apparatus 10 is not limited to a multifunction peripheral, and the present disclosure is also applicable to a specialized device such as a printer, a copier, or a facsimile.

The scanner 12 is provided with an original placement surface (not shown). In the case where the image forming apparatus 10 functions as a copier, when an instruction to start copying is input from an operation panel (not shown) after placement of an original on the original placement surface, the reading operation of the scanner 12 is started, and thereby the image data of the original is read.

The image forming portion 14 forms an image on a print sheet in accordance with the image data read by the scanner 12, and includes, as its main components, a paper feed tray 16 capable of holding print sheets, a plurality of feeding portions 17, a transfer device 15 that transfers a toner image onto a print sheet fed from the paper feed tray 16, a fixing device 19 that fixes a toner image transferred to a print sheet, on the print sheet, a plurality of conveyance rollers 22 that convey the print sheet to which the toner imager has been fixed, a control portion 60 (see FIG. 2) that controls these components, a motor 67 (see FIG. 2) that supplies a rotational driving force to the fixing device 19, and a motor driver 66 that controls the motor 67. These components are disposed within a casing 20 (corresponding to a housing of the present disclosure) that constitutes the housing of the image forming portion 14. Note that the motor 67 is an example of a rotary drive source recited in the claims.

The sheet discharge space 21 that is open at its front is defined between the top portion of the casing 20 and the scanner 12. A sheet discharge tray 23 is provided in the sheet discharge space 21. A print sheet that has been fed from the paper feed tray 16 by the feeding portions 17 is moved upward along a conveyance path 24 defined on the right side within the casing 20. In the process of this movement, the toner image is transferred to the print sheet by the transfer device 15. The toner image transferred to the print sheet is heated and melted while the print sheet is passing through the fixing device 19, and is thereby fixed to the print sheet. The print sheet that has passed through the fixing device 19 is guided upward by the conveyance rollers 22 via a conveyance path 28 defined on the left side in the casing 20, then discharged from a discharge port 31 to the sheet discharge space 21, and is held by sheet discharge tray 23.

As shown in FIG. 1, the fixing device 19 is provided within the casing 20 on the downstream side in the conveyance direction relative to the transfer device 15. The fixing device 19 includes a heating roller 38 (an example of a drive roller and a fixing roller recited in the claims) and a pressure roller 39 disposed so as to oppose the heating roller 38. The heating roller 38 is supported, together with the pressure roller 39, by a frame 34 provided in the casing 20, so as to be rotatable in contact with the print sheet. The pressure roller 39 is pressed against the heating roller 38 by a spring or the like. The heating roller 38 is coupled to the motor 67 which is drive-controlled by the motor driver 66 described later, via a drive transmission mechanism (not shown). As a result of the motor 67 being rotationally driven by the motor driver 66, the rotational driving force of the motor 67 is transmitted to the heating roller 38, which is thereby rotated in a predetermined direction. As the heating roller 38 is rotated, the pressure roller 39 in contact with the heating roller 38 is rotated together.

In the fixing device 19, in order to melt the toner, the heating roller 38 is heated such that its surface temperature reaches about 200° C. In the present embodiment, the outer circumferential surface of the heating roller 38 is heated from one direction by an IH heater 42 (an example of a heating device recited in the claims) using induction heating and provided above the heating roller 38. When a print sheet is conveyed to a nip portion formed between the heating roller 38 and the pressure roller 39, the heating roller 38 conveys the print sheet in a sandwiched manner, and applies heat to a toner image formed on the print sheet by the transfer device via contact therewith so as to weld the toner image to the print sheet. A temperature sensor 44 for detecting the temperature of the outer circumferential surface of the heating roller 38 is provided in the vicinity of the heating roller 38, and a detection signal from the temperature sensor 44 is input into the control portion 60. Note that the heating device is not limited to the IH heater 42, and a heating device such as a halogen heater can also be used.

The rotational shaft of the heating roller 38 of the fixing device 19 is provided with a rotary encoder 35 (see FIG. 2) for detecting the rotational state of the heating roller 38. The rotary encoder 35 outputs a state signal corresponding to the rotational state of the heating roller 38 to the control portion 60. Specifically, when the heating roller 38 is rotating, the rotary encoder 35 outputs a rotation signal indicating the rotating state to the control portion 60, and, when the heating roller 38 is stopped, the rotary encoder 35 outputs a stop signal indicating the stopped state to the control portion 60. Note that any of various rotation detection sensors can be used in place of the rotary encoder 35, as long as the sensor outputs a signal indicating the rotational state of the heating roller 38.

The print sheet that has been conveyed to the fixing device 19 is conveyed while being sandwiched between the heating roller 38 and the pressure roller 39, and thereby the toner image formed on the print sheet is pressed while being heated. This allows the toner image to be welded to the print sheet. Thereafter, the print sheet is discharged onto the sheet discharge tray 23.

A cover 25 (an example of a cover member recited in the claims) for opening the interior of the casing 20 is provided on the left side surface of the casing 20. An opening 27 that leads to the conveyance path 28 extending from the fixing device 19 is formed in the left side surface of the casing 20. The cover 25 is supported so as to be able to change its position between a closed position (the position indicated by the solid line in FIG. 1) to close the opening 27 and an open position (the position indicated by the broken line in FIG. 1) to open the opening 27. Specifically, the cover 25 is supported by a support shaft 26 provided at its lower end, so as to be able to pivot between the closed position and the open position. The cover 25 is closed or opened when the sheet removal operation (jam processing operation) is performed. As a result of the cover 25 being pivoted into the open position, the opening 27 is opened to expose the conveyance path 28. Accordingly, even if a print sheet is jammed while being sandwiched between the heating roller 38 and the pressure roller 39 in the fixing device 19, it is possible to perform the sheet removal operation of removing the print sheet from the opening 27 by pulling the print sheet to the left from the conveyance path 28 side.

Within the casing 20, a cover switch 29 (see FIG. 2, an example of a cover opening/closing detection sensor recited in the claims) for detecting the open/closed state of the cover 25 is provided. The cover switch 29 outputs an electric signal corresponding to the open position of the cover 25 (hereinafter referred to as "open signal") and an electric signal corresponding to the closed position (hereinafter referred to as "close signal"). The output signal is input into the control portion 60. Note that as the cover switch 29, it is possible to use, for example, a mechanical sensor such as a microswitch, or a photosensor.

Figure 2:
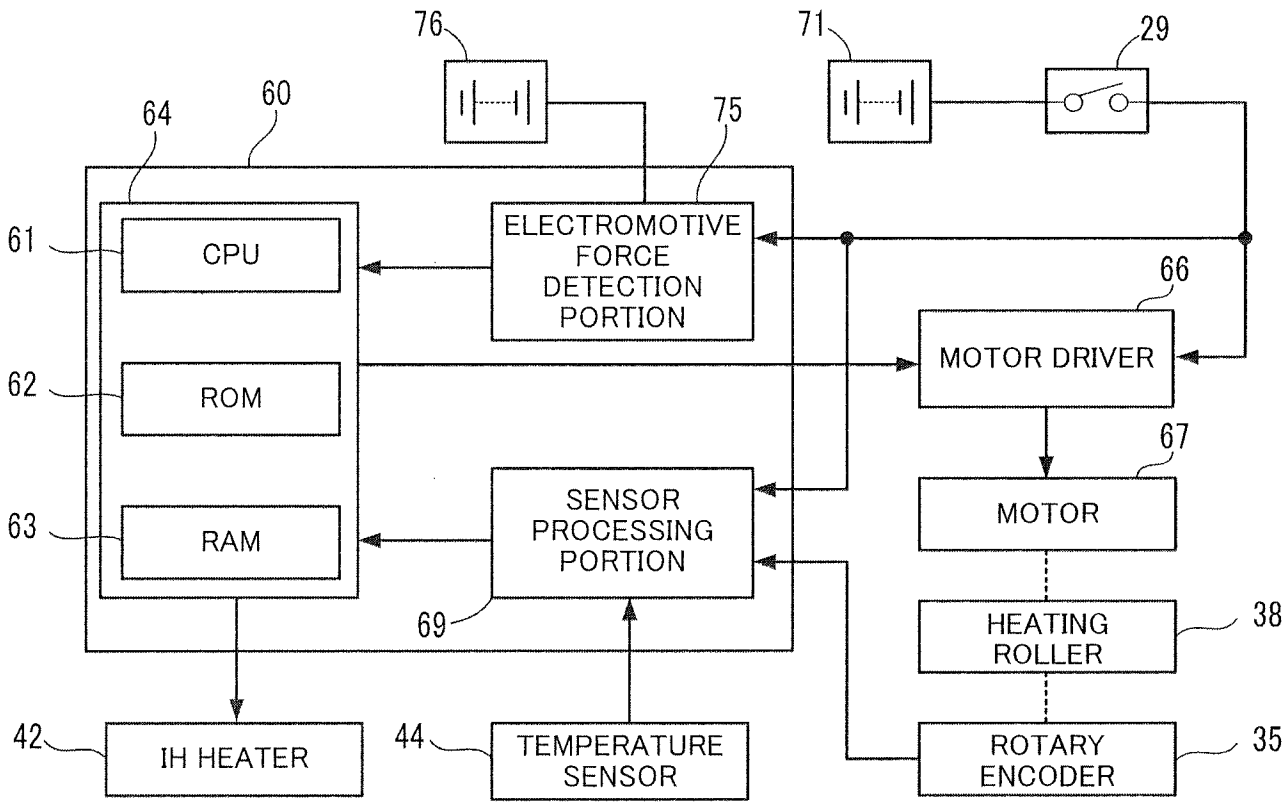
FIG. 2 is a block diagram showing a configuration of a control portion provided in the image forming apparatus shown in FIG. 1.

The motor 67 supplies a rotational driving force to the heating roller 38, and may be a stepping motor, for example. The drive of the motor 67 is controlled by the motor driver 66. As shown in FIG. 2, a drive voltage (e.g., DC 24 V) is supplied to the motor driver 66 from a direct-current power supply 71 via the cover switch 29. The motor 67 can be energized by the drive voltage input into the motor driver 66, so that the motor 67 can output the rotational driving force corresponding to a drive control signal input from the control portion 60. In addition to the motor driver 66, other drive loads such as a solenoid and the IH heater 42 are connected to the direct-current power supply 71 via the cover switch 29.

In the present embodiment, the contact of the cover switch 29 is closed by a projection (not shown) provided on the cover 25 pressing the switch portion of the cover switch 29 when the cover 25 is at the closed position. Then, upon the closure of the cover switch 29, the motor driver 66 is brought into a state in which the drive voltage is supplied thereto. In this case, the motor 67 can be energized by control of the control portion 60. When the cover 25 is brought into the open position, the contact opens and the drive voltage is no longer supplied to the motor driver 66. Thus, in this case, the motor 67 is always de-energized regardless of control by the control portion 60, so that the motor 67 will not rotate. Thus, the cover switch 29 implements not only the cover closing/opening detection function of detecting the opening/closing of the cover 25, but also the function as an interlock in the drive voltage supply path to the drive loads such as the motor 67.

Next, a description will be given of the control portion 60. The control portion 60 performs overall control of the image forming apparatus 10, and includes, as shown in FIG. 2, a calculation portion 64 composed of a CPU 61, a ROM 62, and a RAM 63, a sensor processing portion 69, and an electromotive force detection portion 75 (an example of a rotation signal detection portion recited in the claims), for example. In the calculation portion 64, the processing in accordance with a predetermined program stored in the ROM 62 is executed by the CPU 61.

In the present embodiment, the ROM 62 stores a determination program for implementing removal determination processing of determining whether a print sheet is removed in the event of a jam occurring in the fixing device 19. Then, the CPU 61 of the calculation portion 64 reads out and executes the determination program, and thereby the removal determination processing is performed. The removal determination processing is processing performed by the control portion 60 including the CPU 61, based on detection of an electromotive force in the motor 67 by the electromotive force detection portion 75. The details of the removal determination processing will be described later. Note that the removal determination processing is not limited to a program executed by the CPU 61, and may be implemented, for example, by an electronic circuit such as an integrated circuit (ASIC).

The motor driver 66 and the sensor processing portion 69 are each composed of an electronic circuit such as an integrated circuit (ASIC) and an internal memory, for example. The motor driver 66 is electrically connected to the motor 67. The motor driver 66 controls drive of the motor 67 by energizing the motor 67 based on a drive control signal from the calculation portion 64. As a result of the motor 67 being rotationally driven, the heating roller 38 is rotated. The sensor processing portion 69 is electrically connected to the rotary encoder 35, the temperature sensor 44, and the cover switch 29. The sensor processing portion 69 converts output signals input from the rotary encoder 35, the temperature sensor 44, and the cover switch 29 into signals that can be processed in the calculation portion 64.

The calculation portion 64 controls the surface temperature of the heating roller 38 and determines whether an abnormality of the IH heater 42 has occurred, based on the output signal from the temperature sensor 44 that has been converted by the sensor processing portion 69. Specifically, the calculation portion 64 controls heating of the IH heater 42 such that the temperature of the outer circumferential surface of the heating roller 38 is a constant temperature. Additionally, the control portion 60 determines whether a temperature abnormality of the IH heater 42 and the heating roller 38 has occurred based on whether or not the temperature of the outer circumferential surface of the heating roller 38 reaches an abnormality temperature.

The calculation portion 64 determines the rotational state of the heating roller 38, or in other words, whether the heating roller 38 is rotating or stopped based on the output signal from the rotary encoder 35 that has been converted by the sensor processing portion 69. If the output signal from the rotary encoder 35 is a pulse signal (hereinafter referred to as "rotation signal"), the calculation portion 64 determines that the heating roller 38 is rotating. If the output signal from the rotary encoder 35 is a signal indicating a constant value (hereinafter referred to as "stop signal"), it determines that the heating roller 38 is stopped. If it is determined that the rotation is stopped, this means that excessive heating will be performed by the IH heater 42. Thus, in this case, the control portion 60 forcibly stops the heating operation of the IH heater 42.

Further, the calculation portion 64 determines the open/closed state of the cover 25 based on the output signal from the cover switch 29 that has been converted by the sensor processing portion 69. Possible examples of the output signal from the cover switch 29 include low voltage signals resulting from the drive voltage (DC 24 V) of the direct-current power supply 71 being stepped down to a low voltage such as 5 V or 3.3 V by the sensor processing portion 69. If a low voltage signal is input, it is determined that the cover 25 is at the closed position. If a low voltage signal is not input, it is determined that the cover 25 is at the open position.

Figure 3:
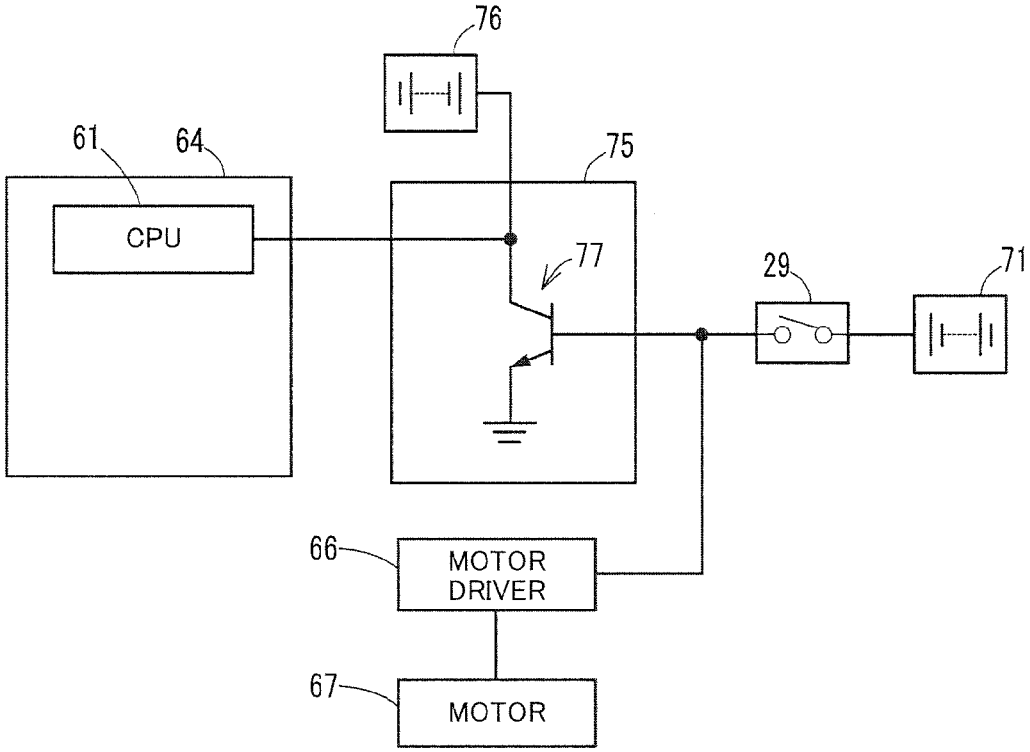
FIG. 3 is a block diagram showing a configuration of an electromotive force detection portion of the control portion shown in FIG. 2.

The electromotive force detection portion 75 detects a rotation signal indicating that the heating roller 38 is rotated while the motor 67 is being powered off as a result of the cover switch 29 being turned off. More specifically, the electromotive force detection portion 75 detects, as the rotation signal, a counter electromotive force generated from the motor 67 as a result of the heating roller 38 being rotated while the motor 67 is being powered off. As shown in FIG. 3, the electromotive force detection portion 75 includes an NPN-type transistor 77. The base terminal of the transistor 77 is connected to the cover switch 29 and the motor driver 66. The collector terminal of the transistor 77 is connected to a low voltage source 76 that supplies a low voltage and the CPU 61 of the calculation portion 64. The emitter terminal of the transistor 77 is grounded. In the electromotive force detection portion 75 having this circuit configuration, when the motor 67 is powered off as a result of the cover switch 29 being turned off, the potential of the base terminal is zero. Accordingly, a low voltage will not be supplied from the control voltage source to the collector terminal. At this time, the CPU 61 cannot detect a low voltage at the collector terminal. On the other hand, in the case where a jam has occurred in the fixing device 19, when the heating roller 38 is rotated by a jammed print sheet being pulled out, the motor 67 is also rotated. Consequently, a counter electromotive force of about 4 V is generated from the motor 67. This generation of the counter electromotive force continuously occurs while the heating roller 38 is being rotated as a result of the print sheet being pulled. The counter electromotive force of 4 V is input into the base terminal of the transistor 77, thus causing the transistor 77 to operate. That is, the collector terminal and the emitter terminal of the transistor 77 are brought into electrical communication, causing a low voltage from the control voltage source to flow from the collector terminal to the emitter terminal. At this time, the CPU 61 detects a low voltage at the collector terminal. As a result of detecting the low voltage, the CPU 61 detects a counter electromotive force that has been generated while the motor 67 is being turned off, as the rotation signal.

Note that the control portion 60 controls the conveyance operation performed by the feeding portions 17, the transfer operation performed by the transfer device 15, the fixing operation performed by the fixing device 19, the conveyance operation performed by the conveyance rollers 22, and so forth, in the image forming apparatus 10. Further, the control portion 60 performs control (warm-up control) to operate the feeding portions 17, the transfer device 15, the IH heater 42, the heating roller 38, the conveyance rollers 22 and so forth to enable printing processing in such cases where the main power supply of the image forming apparatus 10 is turned on, where the mode is shifted to a power saving mode when the image forming apparatus 10 has not been used for a certain period of time, and the mode is thereafter returned to a normal mode, and where the cover 25 is placed at the closed position after being placed at the open position for maintenance or jam processing. Such switching of control modes is a conventionally well-known method, and therefore, the detailed description thereof has been omitted here.

Figure 4:
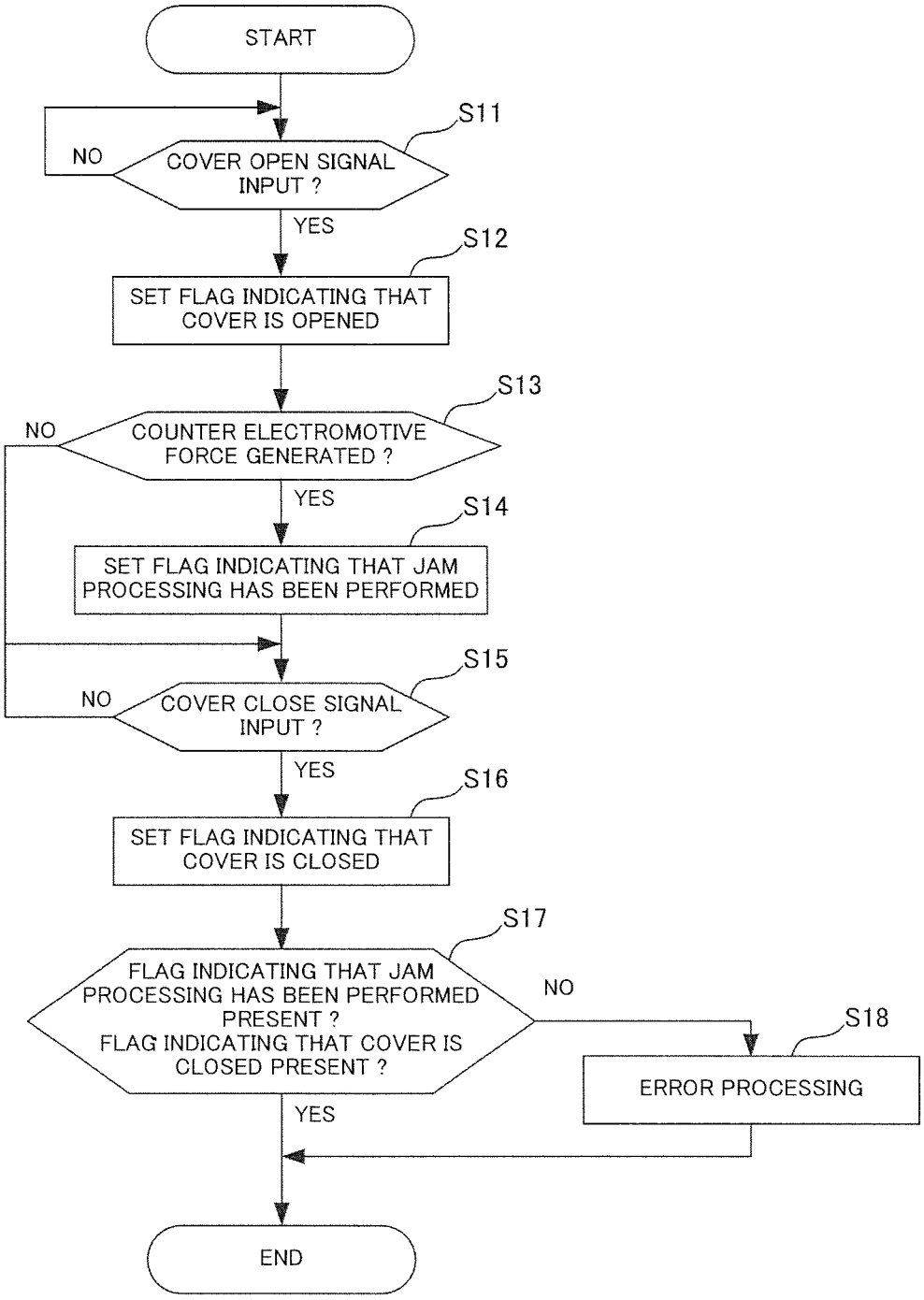
FIG. 4 is a flowchart illustrating an example of the procedure of removal determination processing performed by the control portion shown in FIG. 2.

Referring next to the flowchart in FIG. 4, a description will be given of an example of the procedure of removal determination processing performed by the control portion 60. In FIG. 4, S11, S12, and so forth each denote the number of the processing procedure (step). The processing in each step is performed by the control portion 60, more specifically, by the CPU 61 of the calculation portion 64 executing the program in the ROM 62. The removal determination portion recited in the claims is implemented by the control portion 60 performing the following removal determination processing. Note that the following description assumes that a jam has occurred in a state in which a print sheet is caught between the heating roller 38 and the pressure roller 39 of the fixing device 19 or in a state in which a print sheet is caught on either the heating roller 38 or the pressure roller 39.

In the case where a jam occurs in the fixing device 19, the operator opens the cover 25 of the casing 20 and starts the operation of removing the print sheet jammed inside. When the cover 25 of the casing 20 is opened and its position is changed from the closed position to the open position in the process of the removal operation, the open signal is output from the cover switch 29. In step S11, the control portion 60 determines whether the open signal has been input. Then, if it is determined that the open signal has been input, the control portion 60 sets a flag indicating that the cover is open in a register of the CPU 61 in the next step S12. When the cover 25 is opened, the drive voltage is not supplied to the motor driver 66 as described above, so that the motor 67 is powered off. Likewise, other loads such as the IH heater 42 are also powered off.

Subsequently, the control portion 60 determines whether a counter electromotive force has been generated from the motor 67 that is being powered off (S13). This determination is made based on the presence or absence of the low voltage input into the CPU 61 from the electromotive force detection portion 75. Specifically, the control portion 60 determines that the counter electromotive force has been generated if a low voltage is input from the electromotive force detection portion 75, and determines that the counter electromotive force has not been generated if the low voltage is not input. In other words, the control portion 60 determines whether the print sheet that has stopped in contact with the heating roller 38 is removed, based on detection of the counter electromotive force. Here, as described above, the counter electromotive force that is generated while the motor 67 is being powered off means that the jammed print sheet is removed by the operator.

If it is determined in step S13 that the counter electromotive force has been generated, the control portion 60 sets a flag indicating that the jam processing has been performed in the register of the CPU 61 in the next step S14. If, on the other hand, it is determined that the counter electromotive force has not been generated, the control portion 60 proceeds to step S15 without setting a flag indicating that the jam processing has been performed. Note that if generation of the counter electromotive force cannot be determined within a certain period of time, an error message or error sound may be output externally.

Next, in step S15, the control portion 60 determines whether the close signal of the cover 25 has been input. Here, if it is determined that the close signal has been input, the control portion 60 sets a flag indicating that the cover is closed in the register of the CPU 61 in the next step S16. Note that the determination processing in step S15 is performed until the close signal is input.

In the next step S17, the control portion 60 determines whether both the flag indicating that the jam processing has been performed and the flag indicating the cover close signal are present. Here, if it is determined that both of the flags are present, the control portion 60 determines that the print sheet that has been jammed being sandwiched between the heating roller 38 and the pressure roller 39 is reliably removed by the operator, and enables the image forming operation, for example, by performing the warm-up control of the image forming apparatus 10. Note that closing of the cover 25 causes voltage to be supplied to the motor 67 from the direct-current power supply 71, thus bringing the motor 67 into an energized state. If, on the other hand, it is determined in step S17 that, only the flag indicating that the cover is closed, instead of the both flags, is present, the control portion 60 performs error processing of externally outputting an error message or an error display indicating that removal of the print sheet has not been completed, or interrupting a power supply circuit that supplies power to the drive loads such as the motor 67 (S18).

Because of the image forming apparatus 10 configured as described above, when a print sheet that has stopped in contact with the heating roller 38 is pulled out in the jam processing operation performed by the operator, the heating roller 38 is rotated together with this movement of the print sheet by the frictional force therebetween, thus rotating the output shaft of the motor 67. At this time, the counter electromotive force indicating that the motor 67 is rotating is detected by the electromotive force detection portion 75. The generation of the counter electromotive force means that the operation of removing the print sheet is being performed by the operator. Thus, it is possible to reliably determine that the print sheet is removed when the CPU 61 of the control portion 60 has recognized the generation of the counter electromotive force. In this case, the control portion 60 brings the image forming apparatus 10 into a state in which the image forming apparatus 10 can form an image, for example. If, on the other hand, the generation of the counter electromotive force cannot be recognized, the control portion 60 recognizes that the removal of the print sheet has not been performed, and brings the image forming apparatus 10 into a state in which the image forming apparatus 10 cannot perform the image forming operation, for example.

The control portion 60 can reliably determine that the operation of removing the print sheet has been completed by determining the presence of both of the flag indicating that the jam processing has been performed and the flag indicating the cover close signal in step S17 described above.

Although the above embodiment has been described the processing example performed in the case where a jam has occurred between the heating roller 38 and the pressure roller 39, the present disclosure is also applicable to, for example, a case where a jam has occurred in a state in which a print sheet is caught between the conveyance rollers 22 that are rotationally driven by a motor. In this case, each of the conveyance rollers 22 corresponds to the drive roller of the present disclosure, and the motor (not shown) configured to rotate the conveyance rollers 22 corresponds to the rotary drive source recited in the claims.

Although the above embodiment illustrates the electromotive force detection portion 75 as an example of the rotation signal detection portion recited in the claims, the present disclosure is not limited thereto. It is possible to use the rotary encoder 35 connected to the rotational shaft of the heating roller 38 as an example of the rotation signal detection portion in place of the electromotive force detection portion 75.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a fixing roller configured to be able to rotate in contact with a printing medium while being heated by a heating device and contact and heat a toner image formed on the printing medium so as to weld the toner image to the printing medium;

a motor configured to supply a rotational force to the fixing roller;

a motor driver configured to receive a drive voltage supplied from a power supply and control drive of the motor by the drive voltage;

a cover member configured to be able to change a position thereof between an open position to open an opening formed in a housing of the image forming apparatus and a closed position to close the opening, and be opened or closed when the printing medium that has stopped in contact with the drive roller is removed;

a cover switch including a contact whose one end is connected to the power supply and another end is connected to the motor driver, and configured to output an open signal corresponding to the open position and a close signal corresponding to the closed position, and power off the motor by opening the contact when the cover member is at the open position;

a rotation signal detection portion connected to a voltage supply path which extends from the cover switch to the motor driver, and configured to output, as a rotation signal indicating that the fixing roller is rotated, a counter electromotive force generated from the motor as a result of the fixing roller being rotated while the motor is being powered off by the cover switch; and a control portion connected to the cover switch in such a way that the open signal and the close signal can be input, connected to the rotation signal detection portion in such a way that the rotation signal can be input, and configured to, when the rotation signal is input from the rotation signal detection portion while the open signal has been input from the cover switch, and then the close signal is input from the cover switch, determine that the printing medium that has stopped in contact with the fixing roller is removed, wherein when the rotation signal is not input from the rotation signal detection portion while the open signal has been input, and then the close signal is input from the cover switch, the control portion interrupts a power supply circuit that supplies power to drive loads including the motor.

2. The image forming apparatus according to claim 1, wherein the rotation signal detection portion includes an NPN-type transistor, a base terminal of the transistor is connected to the cover switch and the motor driver, a collector terminal of the transistor is connected to a low voltage source that supplies a low voltage, an emitter terminal of the transistor is grounded, and the rotation signal detection portion outputs, from the collector terminal as the rotation signal, the low voltage that is input to the collector terminal when the counter electromotive force is input to the base terminal.

* * * * *